United States Patent [19]

Boie et al.

[11] Patent Number: 4,847,179

[45] Date of Patent: Jul. 11, 1989

[54] PHOTOGRAPHIC DYE DIFFUSION TRANSFER PROCESS AND COLOR PHOTOGRAPHIC RECORDING MATERIAL SUITABLE FOR THIS PROCESS

[75] Inventors: Immo Boie, Leichlingen; Manfred Peters; Wolfgang Himmelmann, both of Leverkusen; Thomas Kaluschke, Leichlingen; Günther Schenk, Cologne; Kaspar Wingender; Karl Frank, both of Leverkusen, all of Fed. Rep. of Germany

[73] Assignee: AGFA-Gevaert Aktiengessellschaft, Leverkusen, Fed. Rep. of Germany

[21] Appl. No.: 109,901

[22] Filed: Oct. 19, 1987

[30] Foreign Application Priority Data

Oct. 30, 1986 [DE] Fed. Rep. of Germany ..... 3636971

[51] Int. Cl.[4] ..... G03C 5/54; G03C 1/34

[52] U.S. Cl. ..... 430/203; 430/219; 430/607; 430/613; 430/617; 430/619

[58] Field of Search ..... 430/203, 214, 219, 372, 430/617, 619, 607, 613, 551, 239

[56] References Cited

U.S. PATENT DOCUMENTS

| | | | |
|---|---|---|---|
| 3,743,504 | 7/1973 | Dappen et al. | 430/214 |
| 4,599,296 | 7/1986 | Sakaguchi et al. | 430/203 |
| 4,696,887 | 9/1987 | Sato et al. | 430/203 |

*Primary Examiner*—Richard L. Schilling
*Attorney, Agent, or Firm*—Connolly & Hutz

[57] ABSTRACT

Water-soluble substantially non-hardening aldehydes or water-soluble substantially non-hardening aldehyde precursor compounds are suitable as fog-reducing compounds for the photographic dye diffusion transfer process in which an imagewise-exposed color photographic recording material containing light-sensitive silver salt and a non-diffusing dye-releasing compound in at least one binder layer arranged on a layer support, is developed, preferably under the effect of heat, to produce a diffusible dye image and in which the diffusible dye image is transferred to an image receptor layer.

5 Claims, No Drawings

PHOTOGRAPHIC DYE DIFFUSION TRANSFER PROCESS AND COLOR PHOTOGRAPHIC RECORDING MATERIAL SUITABLE FOR THIS PROCESS

This invention relates to a photographic dye diffusion transfer process for the production of coloured diffusion images and in particular to a process of this kind in which development is brought about by the action of heat. Non-diffusible dye releasing compounds are used for producing the dye images. Development is carried out in the presence of an aldehyde in order to reduce the fog. This aldehyde may be present either as such or in the form of a precursor compound in one of the layers of the colour photographic recording material.

Photographic recording materials, including those used for colour photography, normally contain at least one layer of binder in which the light sensitive silver halide and optionally the substances required for producing the colour image are dispersed, and such layers are in most cases hardened to protect them against mechanical damages,, especially during processing. The hardeners may be chosen from numerous classes of compounds, including aldehydes, especially dialdehydes. The present invention relates to substantially non-hardening aldehydes and their precursor compounds for use as fog reducing additives in colour photographic recording materials for the dye diffusion transfer process.

Heat developable photographic recording materials containing silver halide emulsions as light sensitive additives have already been described. A survey of the use of silver halide emulsions in hydrophilic and hydrophobic media forr thermographic processes may be found, for example, in Research Disclosure 17029 (June 1978). The silver halidee may serve not only to form the latent image and contribute metallic silver for building up the image but also as oxidizing agent for subsequent colour reactions. The colour producing compounds used may consist inter alia of conventional colour couplers or leuco dye bases which give rise to a dye image when oxidized.

Particularly suitable colour producing compounds are those which can be incorporated in a non-diffusible form in the layer of a photographic recording material and are capable of releasing a diffusible dye as a result of development (dye releasing compounds). The special suitability of such dye releasing compounds is due to the fact that the dyes which have been released imagewise can be transferred to special image receptor layers to form a brilliant colour image on which no image silver or silver halide is superimposed and which therefore requires no after treatment. The combination of heat development process with dye diffusion process thus provides an advantageous rapid process for the production of colour images. A suitable recording material for this purpose is described, for example, in DE-A-32 15 485.

According to the said prior publication, a recording material having a layer which contains a combination of silver halide, silver benzotriazolate, a dye releasing compound and guanidine trichloroacete (base donor) is exposed imagewise and then subjected to a heat treatment while in contact with an image receptor sheet so that the dye which is released imagewise is transferred to the receptor sheet. For the production of multicolour images it is necessary to use several such combinations in which the silver halide in each combination is sensitive to a different spectral region of light and is associated, according to its spectral sensitivity, with a dye releasing compound which releases a dye of a different colour, in most cases a colour which is complementary to the colour of the light to which the particular silver halide is predominatly sensitive. Such associations may be arranged above one another in different layers.

One problem, however, lies in the image fog, which is in many cases still too high. This becomes particularly clear when the photographic material is unduly exposed to heat, for example in prolonged photographic processes, which result in a marked increase in the fog values. The margin of conditions within which such a material may be processed is thereby severely restricted and obtaining uniform image results is then, of course, problematic.

It is an object of the present invention to provide a photographic dye diffusion transfer process and a recording material suitable for this process by which coloured transfer images with low fog values could be produced. Another object of the present invention lies in providing a heat developable photographic recording material which has a high resistance to fogging so that the material is less affected by fluctuation in the processing conditions. It is also an object of the present invention to develop a recording material with improved Dmin/Dmax ratios.

These objects are achieved according to the present invention by carrying out development in th e presence of a water soluble, substantially non-hardening aldehyde or a water soluble, substantially non-hardening aldehyde precursor compound.

The present invention relates to a photographic dye diffusion transfer process in which an imagewise exposed colour photographic recording material containing a light sensitive silver salt and a non-diffusible dye releasing compound in at least one layer of binder on a layer support, is developed to produce a diffusible dye image, and the diffusible dye image is transferred to an image receptor layer, characterised in that development is carried out in the presence of a water soluble, substantially non-hardening aldehyde or a water soluble, substantially non-hardening aldehyde precursor compound.

Development is preferably effected by heat treatment and this is most preferably applied from outside without the aid of a processing liquid.

The fog reducing compounds used according to the invention are soluble in water. This means that at least 0.1 g, preferably not less than 5 g of the given compound will dissolve in 100 ml of water at 20° C.

The fog reducing compounds used according to the invention are substantially non-hardening. This means that the state of hardening of the layers of colour photographic recording material is not substantially altered by the presence of the fog reducing compounds used according to the invention.

Many aldehydes, especially dialdehydes, exert a cross-linking effect on gelatine, which is the substance normally used as binder, and they are therefore frequently used as hardeners. The present invention does not relate to such cross-linking aldehydes and aldehyde derivatives although the possibility of aldehydes and aldehyde derivatives of this kind also being used as fog reducing compounds cannot be excluded. If, however, the fog reducing compound used is an aldehyde precursor compound from which an aldehyde which has a hardening action is released on development, then this is harmless for the purpose of the invention so long as the aldehyde precursor compound itself has no hardening action and so long as at the moment of release of the aldehyde in the course of development the ultimate state of hardening has already been reached or will no longer undergo a significant change.

The substantially non-hardening aldehyde used according to the invention or the aldehyde released from the substantially non-hardening aldehyde precursor compound in the course of development may be represented, for example, by the following formula I

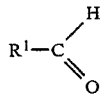

I wherein:

$R^1$ denotes H, alkyl, aralkyl or $-(NH)_n-R^2$, $R^2$ denoting aryl or a heterocyclic group and n=0 or 1.

In the above formula, the groups denoted by $R^1$ may be substituted, e.g. by COOH, $SO_3H$ or OH so that the given aldehyde or aldehyde precursor compound is rendered soluble in water. Furthermore, the groups $R^1$ may also contain other substituents, such as halogen atoms or alkyl, aryl, amino, sulphonamido, carbonamido, carbamoyl or sulphamoyl groups. However, the group $R^1$ does not contain any additional aldehyde group or any other reactive group capable of reacting with the amino groups present in gelatine, unless the aldehyde is present in the form of an aldehyde precursor compound containing masked aldehyde groups.

In the aldehyde precursor compound, the aldehyde group is present in a masked form, e.g. as acetal, Schiff's base or hydrogen sulphite addition product.

The following are examples of suitable fog reducing compounds:

AV-1

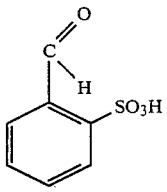

AV-2

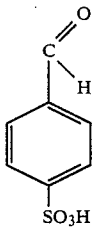

AV-3

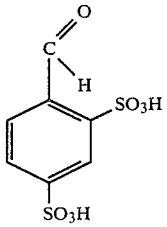

-continued

AV-4

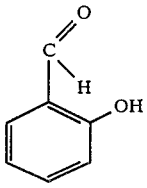

AV-5

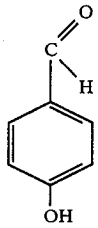

AV-6

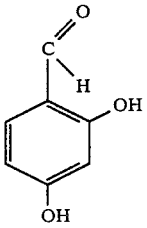

AV-7

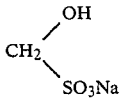

AV-8

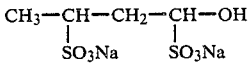

AV-9

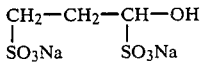

AV-10

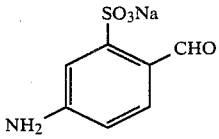

AV-11

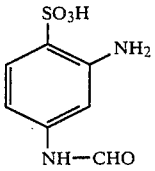

The aldehydes and aldehyde precursor compounds used according to the invention are known compounds. Methods for their preparation are given in the relevant literature.

The aldehydes or aldehyde precursor compounds may be introduced into one or more layers of the photographic material. They are preferably introduced into a layer adjacent to the silver halide layer. The fog reducing aldehyde additives may be applied in quantities of from 0.05 to 10.0 g/m$^2$.

One essential component of the colour photographic recording material used according to the invention is silver halide, which may consist of silver chloride, silver bromide, silver iodide or mixtures thereof and may have a particle size of from 0.02 to 2.0 μm, preferably from 0.1 to 1.0 μm. The silver halide grains may have a regular crystal structure, for example they may have a cubic or octahedral form, or they may have a spherical form or a tabular form. In the case of mixed crystals, the silver halides may be uniformly distributed over the whole crystal cross section or the silver halide composition may vary from one region to another. The silver halide emulsions may also have a layered grain structure in which at least two layers differ in their silver halide composition. Negatively functioning silver halide emulsions are generally used although according to a further embodiment, direct, positive silver halide emulsions may be used, for example as described in DE-A-23 32 802, DE-A-23 08 239 and DE-A-22 11 728. The light sensitive emulsion may be present as non-sensitized silver halide or it may have been chemically and/or spectrally sensitized with suitable additives which may be added before, during or after chemical ripening.

The quantity of light sensitive silver halide in any given layer may vary from 0.01 to 3.0 g per $m^2$. The actual quantity should be adjusted to the particular requirements of the various reactants used in the layer arrangement and the desired effects.

It is well known that photographic recording materials capable of being developed by heat treatment may contain other, substantially light insensitive or at least very much less light sensitive silver salts in addition to the light sensitive silver halides. It is particularly advantageous to add organic silver salts which may be equally soluble or less soluble than the light sensitive silver halide. Silver salts of organic cyclic imino compounds, for example, are suitable. In preferred examples, these salts include silver salts of benzotriazole and its derivatives, e.g. alkyl-, hydroxy-, sulpho- or halogen-substituted benzotriazoles. The organic silver salt compound may be added in a molar excess, compared with the silver halide, or in an equimolar or subequivalent quantity. Each should be adjusted to the particular requirements in the combination of layers.

In addition to the fog reducing compounds according to this invention, other anti-foggants and stabilisers may be used. Fog reducing compounds corresponding to the following formula II, for example, are advantageously used.

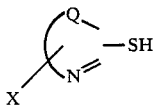

II wherein

Q denotes the group required for completing a heterocyclic group containing at least one 5-membered or 6-membered heterocyclic ring and X denotes a carboxylic or sulphonic acid group or a group containing a carboxylic acid or sulphonic acid group, said carboxylic acid or sulphonic acid group being optionally present in an anionic form, e.g. as alkali metal, alkaline earth metal or ammonium salt or the salt of organic bases, such as trialkyl or tetraalkyl ammonium salts.

Compounds corresponding to the general formula III have particularly advantageous fog reducing effects:

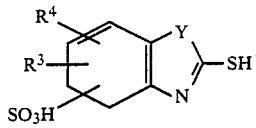

III wherein

Y denotes O, S, Se or $NR^5$;

$R^3$ and $R^4$, which may be identical or different, denote hydrogen, alkyl, preferably with up to 6 carbon atoms such as methyl or ethyl, alkenyl such as allyl, cycloalkyl such as cyclohexyl, aryl such as phenyl, aralkyl such as benzyl or halogen such as Cl or Br or $R^1$ and $R^2$ together may form a condensed benzene ring;

$R^5$ denotes hydrogen, alkyl, preferably with up to 6 carbon atoms, such as methyl or ethyl, alkenyl such as allyl, cycloalkyl such as cyclohexyl, aralkyl such as benzyl or aryl such as phenyl; the aforesaid groups may in turn be substituted, e.g. with hydroxyl, alkoxy or halogen.

The above mentioned heterocyclic mercaptoazole carboxylic acids and sulphonic acids are known compounds and methods for their preparation are described in the relevant literature. Their use has been described, for example, in German patent application P 36 18 118.8.

Another essential component of the colour photographic recording material according to the invention is a non-diffusible colour producing compound. This is capable of releasing a diffusible dye as a result of a redox reaction which takes place in the course of development. This compound will be referred to hereinafter as "dye releasing compound".

The dye releasing compounds used according to the present invention may belong to one of numerous types of compounds which are all distinguished by having a connecting member which is redox dependent in the strength of its bond and links a dye residue to a carrier group containing a ballast residue.

See in this connection a summarizing account of the field in Angew. Chem. Int. Ed. Engl. 22 (1983), 191–209, in which the most important of the known systems are described.

Particularly advantageous for this purpose are the redox active dye releasing compounds corresponding to the formula

BALLAST—REDOX—DYE in which

BALLAST denotes a ballast residue,

REDOX denotes a redox active active group, i.e. a group which can be oxidized or reduced under the conditions of alkaline development and which, depending on whether it is present in the oxidized or reduced state, can undergo to varying degrees an elimination reaction, a nucleophilic displacement reaction, hydrolysis or some other decomposition reaction by which the DYE residue is split off, and DYE denotes the residue of a diffusible dye, e.g. a yellow, magenta or cyan dye or the residue of a dye precursor.

Ballast residues are groups which enable the dye releasing compounds according to the invention to be incorporated in a diffusion fast form in the hydrophilic colloids normally used in photographic materials. These ballast residues are preferably organic groups which generally contain straight chained or branched aliphatic groups, generally with 8 to 20 carbon atoms, and may also contain carbocylic or heterocyclic, optionally aromatic groups. These residues are attached to the remainder of the molecule either directly or indirectly, e.g. through one of the following groups: NHCO; $NHSO_2$; NR in which R stands for hydrogen or alkyl; O or S. The ballast residue may in addition contain water solubilising groups, e.g. sulphogroups or carboxyl groups, and these may also be present in anionic form. Since the diffusion properties depend on the molecular size of the whole compound, it is sufficient in some cases, e.g. if the molecule as a whole is large enough, to use relatively short chained groups as ballast residues.

A wide variety of redox active carrier groups having the structure BALLAST-REDOX-dye releasing compound are known. A detailed description need not be given here, but see the above mentioned article in Angew. Chem. Int. Ed. Engl. 22 (1983) 191–209.

Some examples of redox active carrier groups from which a dye residue is split off after imagewise oxidation or reduction are shown below purely by way of illustration:

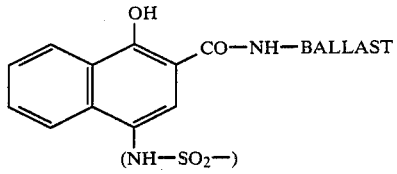

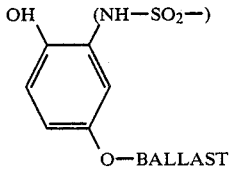

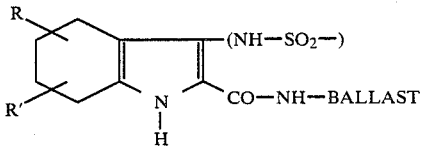

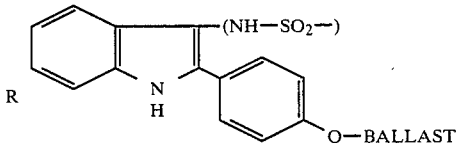

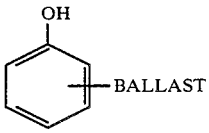

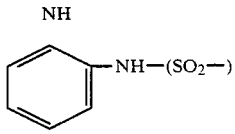

-continued

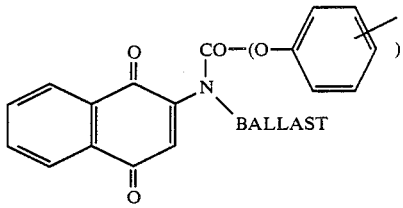

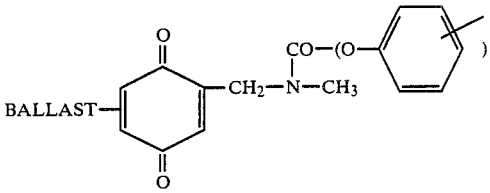

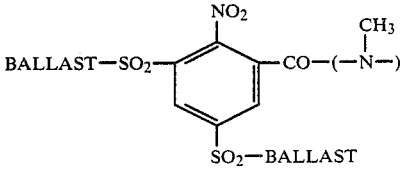

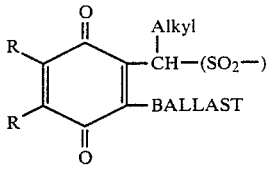

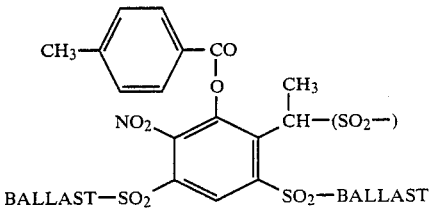

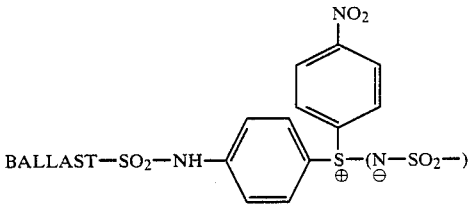

The groups in brackets are functional groups of the dye residue and are separated together with this residue from the remaining part of the carrier group. The functional group may be a substituent which may have a direct influence on the absorption properties and possibly also the complex forming properties of the released dye. On the other hand, the functional group may be separated from the chromophore of the dye by an intermediate member or linking member. Lastly, the functional group may be of some importance in combination with the intermediate member in determining the diffusion and mordanting characteristics of the released dye. The intermediate members may be, for example, alkylene groups or aryl groups.

The dye residues may in principle be residues of any classes of dyes, provided they are sufficiently diffusible to diffuse from the light sensitive layer of the light sensitive material in to an image receptor layer. The dye residues my be provided with one or more alkali solubilising groups for this purpose. Suitable alkali solubilising groups include inter alia carboxyl groups, sulphur groups, sulphonamide groups and aromatic hydroxyl groups. Such alkali solubilising groups may already be preformed in the dye releasing compounds according to the invention or they may result from the release of the dye residue from the carrier group which contains ballast groups. The following are dyes which are particularly suitable for the process according to the invention: azo dyes, azomethine dyes, anthraquinone dyes, phthalocyanine dyes, indigoid dyes and triphenylmethane dyes, including dyes which form complexes or are capable of forming complexes with metal ions.

The residues of dye precursors are residues of compounds which are converted into dyes in the course of the photographic process, either by oxidation or by coupling or by complex formation or by release of an auxochromic group in a chormophoric system, e.g. by saponification, especially under the conditions of heat development. Dye precursors in this sense may by leuco dyes, couplers or dyes which are converted into other dyes in the course of processing. Where it is not necessary to make a distinction between dye residues and the residues of dye precursors, the latter will also be included in the term "dye residues" in the following text.

Suitable dye releasing compounds have been described, for example, in: U.S. Pat. Nos. 3 227 550, 3 443 939, 3 443 940, DE-A-19 30 215, DE-A-22 42 762, DE-A-24 02 900, DE-A-24 06 664, DE-A-25 05 248, DE-A-25 43 902, DE-A-26 13 005, DE-A-26 45 656, DE-A-28 09 716, DE-A-28 23 159, BE-A-861 241, EP-A-0 004 399, EP-A-0 004 400, DE-A-30 08 588, DE-A-30 14 669, GB-A-80 12 242.

In some embodiments of the dye diffusion transfer process according to the invention, the dye releasing compounds may be present in an oxidizable form or capable of coupling while in others they may be present as reducible dye releasing compounds. When comventional negative silver halide emulsions are used, the copy obtained from the original is either a negative or a positive copy, depending on whether the dye has been released from the oxidized or the reduced form of dye releasing compound. It is therefore possible to produce either positive or negative images as desired by suitable choice of the dye releasing systems.

Oxidizable dye releasing compounds which are particularly suitable for the heat developable recording materials according to the invention are described, for example, in DE-A-26 45 656.

If the dye releasing compound is oxidizable, it acts as reducing agent which is oxidized by the imagewise exposed silver halide or by the organic silver salt present in combination with the silver halide, either directly or indirectly by the action of electron transfer agents (ETA). An imagewise differentiation in the capacity to release the diffusible dye is thus obtained. If, on the other hand, the dye releasing compound is reducible, then it is advantageously used in combination with a reducing agent which is present in a limited quantity. This may be a so-called electron donor compound or an electron donor precursor compound, which in this case is present side by side with the dye releasing compound and the light sensitive silver halide in one and the same layer of binder. The presence of an electron transfer agent may also be advantageous when reducable dye releasing compounds are used in combination with electron donor compounds.

An example of a suitable recording material according to the invention for the production of positive colour images from positive originals with the aid of negatively functioning silver halide emulsions contains reducible dye releasing compounds corresponding to the following formula:

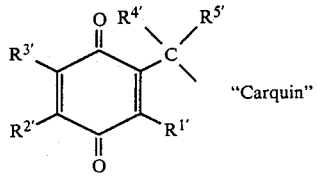

wherein $R^{1'}$ denotes alkyl or aryl;

$R^{2'}$ denotes alkyl, aryl or a group which together with $R^{3'}$ completes a condensed ring;

$R^{3'}$ denotes hydrogen, alkyl, aryl, hydroxyl, halogen such as chorine or bromine, amino, alkylamino and dialkylamino, including cyclic amino groups (such as piperidino or morpholino), acylamino, alkylthio, alkoxy, aroxy, sulfo or a group which together with $R^{2'}$ completes a condensed ring;

$R^{4'}$ denotes alkyl and p1 $R^{5'}$ denotes alkyl or, preferably, hydrogen, and at least one of the groups $R^{1'}$ to $R^{4'}$ contains a ballast residue.

The electron donor compound used in combination with a reducible dye releasing compound serves as reducing agent both for the silver halide and for the dye releasing compound. Since the silver halide and the dye releasing compound thus compete with each other for the oxidation of the electron donor compound and the former is superior to the latter in this respect, the quantity of silver halide present, which depends on the imagewise exposure which has previously taken place, determines the areas of the image within which the dye releasing compound is converted into its reduced form by the electron donor compound.

Under the conditions of development, e.g. when the imagewise exposed colour photographic material is heated, the electron donor compound, which is present in a limited quantity, is oxidized according to the amount of exposure which has previously occurred, and it is then no longer available for a reaction with the dye releasing compound. An imagewise distribution of unused electron donor compound is thus obtained.

Compounds which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A-28 09 716).

Other examples of electron donor compounds are known from DE-A-29 47 425, DE-A-30 06 268, DE-A-31 30 842, DE-A-31 44 037, DE-A-32 17 877 and EP-A-0124 915 and Research Disclosure 24 305 (July 1984). It has been shown that the aforesaid electron donor compounds are able to satisfy the given requirements under the conditions of heat development. Particularly suitable are those electron donor compounds which are formed from the corresponding precursor compounds under the conditions of heat development, i.e. compounds which prior to development are present in the recording material only in a masked form in which they are virtually inactive. The initially inactive electron donor compounds are then converted into their active form under the conditions of heat development, for example by the hydrolytic removal of certain protective groups. For the purpose of the present description, the term "electron donor compound" also extends to these electron donor precursor compounds.

In another embodiment, the dye releasing compounds used may be compounds which are capable of coupling and of releasing a diffusible dye as a result of the coupling reaction. These compounds fall into two groups. In the first, the dye is not formed until chromogenic coupling takes place and a diffusion inhibiting ballast group is split off from the coupling position. In the second case, the couplers exist in a non-diffusible form in which an already preformed dye residue is present as a fugitive group in the coupling position, and this group is split off by the coupling reaction and becomes diffusible. Systems of this kind have been described, for example, in U.S. Pat. No. 3 227 550. The dye releasing compounds may be polymeric couplers of the type which release dyes, as described, for example, in DE-A-34 22 455.

The above mentioned essential components of the recording material according to the invention, namely the special silver halide emulsion and the dye releasing compounds, optionally in combianation with an electron donor compound, are dispersed side by side in one binder. The binder may be either hydrophobic of hydrophilic but is preferably the latter. Gelatine is preferably used as binder for the light sensitive layer but may be partly or completely replaced by other natural or synthetic binders. Examples of natural binders include alginic acid and its derivatives such as its salts, esters or amides, cellulose derivatives such as carboxymethyl cellulose, alkyl celluloses such as hedroxyethyl cellulose, starches and their derivatives, and carragheanates. Polyvinyl alcohols, partially saponified polyvinyl acetate and polyvinyl pyrrolidone are examples of suitable synthetic binders.

Examples of hydrophobic binders include polymers of polymerisable, ethylenically unsaturated monomers such as alkylacrylates, alkylmethacrylates, styrene, vinylchloride, vinylacetate, acrylonitrile and acrylamide. Polyesters, polyurethane compounds and waxes may also be used. These polymers may be used, for example, in the latex form.

For the production of monochrome colour images, the light sensitive layer of binder contains one or more dye releasing compounds associated with the light sensitive silver halide, dyes of a particular colour being released from these compounds. The resulting colour may be obtained by mixing several dyes. It is therefore possible to produce black an white images by using an exactly adjusted mixture of several dye releasing compounds releasing dyes of different colours. A colour photographic recording material according to the present invention used for the production of multi-colour images contains several, i.e. generally three associations of dye releasing compounds with silver halides sensitised to different regions of the spectrum, the range of absorption of the dye released from a given dye releasing compound preferably substantially corresponding to the range of spectral sensitivity of the associated silver halide. The various associations of dye releasing compounds with silver halide may be accommodated in different layers of binders of the colour photographic material, and these various layers of binders are preferably separated by separating layers of a water permeable binder such as gelatine which may contain a scavenger for developer oxidation products, the main function of which is to separate the various associations from one another to counteract falsification of the colours. In such a case, the colour photographic recording material according to the present invention may contain, for example, a light sensitive layer of binder in which the silver halide is predominantly sensitive to the red region as a result of spectral sensitisation and which contains a cyan dye releasing compound; another light sensitive layer of binder in which the silver halide has been spectrally sensitised predominantly to green and which contains a magenta dye releasing compound; and a third light sensitive layer of binder in which the silver halide is predominantly sensitive to blue, either due to its own intrinsic sensitivity or as a result of spectral sensitisation, and which contains a yellow dye releasing compound.

In another embodiment of the present invention, each of the above mentioned associations of light sensitive silver halide with dye releasing compounds is used in the form of a so called complex coacervate. By "complex coacervate" is meant a form of dispersion in which a mixture of the main constituents is enclosed in a common envelope of hardened binder. Dispersions of this kind are referred to as packet emulsion. They are obtained by complex coacervation.

Methods of preparing a packet emulsion in which a colour producing substance is incorporated by complex coacervation are described, for example, in U.S. Pat. Nos. 3 276 869 and 3 396 026. The use of packet emulsions in recording materials which are developable by heat is described, for example, in DE-A-35 10 685.

The use of packet emulsions according to the invention enables several emulsion components, including the dye releasing compounds, to be incorporated in a single layer of binder without any loss in the spectral association so that no colour falsification occurs. This is possible because the amount of dye released from that dye releasing compound which is present in the same coacervate particle (packet) as a given silver halide is determined almost exclusively by the extent to which the silver halide particle has been exposed to light. The use of packet emulsions thus enables one blue sensitive, one green sensitive and one red sensitive silver halide emulsion and the corresponding spectrally associated dye releasing compounds to be accommodated in the same layer of binder without the risk of serious colour falsification.

In addition to the components already mentioned, the colour photographic recording material according to the invention may contain other components and auxiliary substances which may be required, for example, for carrying out heat treatment and the tansfer of dye which forms part of this heat treatment. These other constituents and auxiliary substances may be present in a light sensitive layer or in a light insensitive layer.

These auxiliary substances may include, for example, auxiliary developers. These auxiliary developers generally have the effect of developing exposed silver halide. In the present case, they mainly act by promoting the reactions between the exposed silver halide an the reducing agent which may be identical with the dye releasing compound if the latter is an oxidizable compound whereas if a reducible dye releasing compound is used then the reducing agent may react with the releasto diffuse from the light sensitive layer of the light sensitive material in to an image receptor layer. The dye residues my be provided with one or more alkali solubilising groups for this purpose. Suitable alkali solubilising groups include inter alia carboxyl groups, sulphur groups, sulphonamide groups and aromatic hydroxyl groups. Such alkali solubilising groups may already be preformed in the dye releasing compounds according to the invention or they may result from the release of the dye residue from the carrier group which contains ballast groups. The following are dyes which are particularly suitable for the process according to the invention: azo dyes, azomethine dyes, anthraquinone dyes, phthalocyanine dyes, indigoid dyes and triphenylmethane dyes, including dyes which form complexes or are capable of forming complexes with metal ions.

The residues of dye precursors are residues of compounds which are converted into dyes in the course of the photographic process, either by oxidation or by coupling or by complex formation or by release of an auxochromic group in a chormophoric system, e.g. by saponification, especially under the conditions of heat development. Dye precursors in this sense may by leuco dyes, couplers or dyes which are converted into other dyes in the course of processing. Where it is not necessary to make a distinction between dye residues and the residues of dye precursors, the latter will also be included in the term "dye residues" in the following text.

Suitable dye releasing compounds have been described, for example, in: U.S. Pat. Nos. 3 227 550, 3 443 939, 3 443 940, DE-A-19 30 215, DE-A-22 42 762, DE-A-24 02 900, DE-A-24 06 664, DE-A-25 05 248, DE-A-25 43 902, DE-A-26 13 005, DE-A-26 45 656, DE-A-28 09 716, DE-A-28 23 159, BE-A-861 241, EP-A-0 004 399, EP-A-0 004 400, DE-A-30 08 588, DE-A-30 14 669, GB-A-80 12 242.

In some embodiments of the dye diffusion transfer process according to the invention, the dye releasing compounds may be present in an oxidizable form or capable of coupling while in others they may be present as reducible dye releasing compounds. When comventional negative silver halide emulsions are used, the copy obtained from the original is either a negative or a positive copy, depending on whether the dye has been released from the oxidized or the reduced form of dye releasing compound. It is therefore possible to produce either positive or negative images as desired by suitable choice of the dye releasing systems.

Oxidizable dye releasing compounds which are particularly suitable for the heat developable recording materials according to the invention are described, for example, in DE-A-26 45 656.

If the dye releasing compound is oxidizable, it acts as reducing agent which is oxidized by the imagewise exposed silver halide or by the organic silver salt present in combination with the silver halide, either directly or indirectly by the action of electron transfer agents (ETA). An imagewise differentiation in the capacity to release the diffusible dye is thus obtained. If, on the other hand, the dye releasing compound is reducible, then it is advantageously used in combination with a reducing agent which is present in a limited quantity. This may be a so-called electron donor compound or an electron donor precursor compound, which in this case is present side by side with the dye releasing compound and the light sensitive silver halide in one and the same layer of binder. The presence of an electron transfer agent may also be advantageous when reducable dye releasing compounds are used in combination with electron donor compounds.

An example of a suitable recording material according to the invention for the production of positive colour images from positive originals with the aid of negatively functioning silver halide emulsions contains reducible dye releasing compounds corresponding to the following formula:

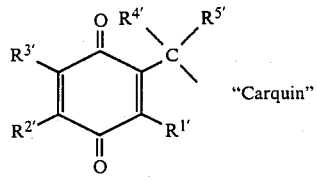

"Carquin"

wherein $R^{1'}$ denotes alkyl or aryl;

$R^{2'}$ denotes alkyl, aryl or a group which together with $R^{3'}$ completes a condensed ring;

$R^{3'}$ denotes hydrogen, alkyl, aryl, hydroxyl, halogen such as chorine or bromine, amino, alkylamino and dialkylamino, including cyclic amino groups (such as piperidino or morpholino), acylamino, alkylthio, alkoxy, aroxy, sulfo or a group which together with $R^{2'}$ completes a condensed ring;

$R^{4'}$ denotes alkyl and p1 $R^{5'}$ denotes alkyl or, preferably, hydrogen, and at least one of the groups $R^{1'}$ to $R^{4'}$ contains a ballast residue.

The electron donor compound used in combination with a reducible dye releasing compound serves as reducing agent both for the silver halide and for the dye releasing compound. Since the silver halide and the dye releasing compound thus compete with each other for the oxidation of the electron donor compound and the former is superior to the latter in this respect, the quantity of silver halide present, which depends on the imagewise exposure which has previously taken place, determines the areas of the image within which the dye releasing compound is converted into its reduced form by the electron donor compound.

Under the conditions of development, e.g. when the imagewise exposed colour photographic material is heated, the electron donor compound, which is present in a limited quantity, is oxidized according to the amount of exposure which has previously occurred, and it is then no longer available for a reaction with the dye releasing compound. An imagewise distribution of unused electron donor compound is thus obtained.

Compounds which have been described as electron donor compounds include, for example, non-diffusible or only slightly diffusible derivatives of hydroquinone, of benzisoxazolone, of p-aminophenol and of ascorbic acid (e.g. ascorbyl palmitate) (DE-A-28 09 716).

Other examples of electron donor compounds are known from DE-A-29 47 425, DE-A-30 06 268, DE-A-31 30 842, DE-A-31 44 037, DE-A-32 17 877 and EP-A-0124 915 and Research Disclosure 24 305 (July 1984). It has been shown that the aforesaid electron donor compounds are able to satisfy the given requirements under the conditions of heat development. Particularly suitable are those electron donor compounds which are formed from the corresponding precursor compounds under the conditions of heat development, i.e. compounds which prior to development are present in the recording material only in a masked form in which they are virtually inactive. The initially inactive electron donor compounds are then converted into their active form under the conditions of heat development, for example by the hydrolytic removal of certain protective groups. For the purpose of the present description, the term "electron donor compound" also extends to these electron donor precursor compounds.

In another embodiment, the dye releasing compounds used may be compounds which are capable of coupling and of releasing a diffusible dye as a result of the coupling reaction. These compounds fall into two groups. In the first, the dye is not formed until chromogenic coupling takes place and a diffusion inhibiting ballast group is split off from the coupling position. In the second case, the couplers exist in a non-diffusible form in which an already preformed dye residue is present as a fugitive group in the coupling position, and this group is split off by the coupling reaction and becomes diffusible. Systems of this kind have been described, for example, in U.S. Pat. No. 3 227 550. The dye releasing compounds may be polymeric couplers of the type which release dyes, as described, for example, in DE-A-34 22 455.

The above mentioned essential components of the recording material according to the invention, namely the special silver halide emulsion and the dye releasing compounds, optionally in combianation with an electron donor compound, are dispersed side by side in one binder. The binder may be either hydrophobic of hydrophilic but is preferably the latter. Gelatine is preferably used as binder for the light sensitive layer but may be partly or completely replaced by other natural or synthetic binders. Examples of natural binders include alginic acid and its derivatives such as its salts, esters or amides, cellulose derivatives such as carboxymethyl cellulose, alkyl celluloses such as hedroxyethyl cellulose, starches and their derivatives, and carragheanates. Polyvinyl alcohols, partially saponified polyvinyl acetate and polyvinyl pyrrolidone are examples of suitable synthetic binders.

Examples of hydrophobic binders include polymers of polymerisable, ethylenically unsaturated monomers such as alkylacrylates, alkylmethacrylates, styrene, vinylchloride, vinylacetate, acrylonitrile and acrylamide. Polyesters, polyurethane compounds and waxes may also be used. These polymers may be used, for example, in the latex form.

For the production of monochrome colour images, the light sensitive layer of binder contains one or more dye releasing compounds associated with the light sensitive silver halide, dyes of a particular colour being released from these compounds. The resulting colour may be obtained by mixing several dyes. It is therefore possible to produce black an white images by using an exactly adjusted mixture of several dye releasing compounds releasing dyes of different colours. A colour photographic recording material according to the present invention used for the production of multi-colour images contains several, i.e. generally three associations of dye releasing compounds with silver halides sensitised to different regions of the spectrum, the range of absorption of the dye released from a given dye releasing compound preferably substantially corresponding to the range of spectral sensitivity of the associated silver halide. The various associations of dye releasing compounds with silver halide may be accommodated in different layers of binders of the colour photographic material, and these various layers of binders are preferably separated by separating layers of a water permeable binder such as gelatine which may contain a scavenger for developer oxidation products, the main function of which is to separate the various associations from one another to counteract falsification of the colours. In such a case, the colour photographic recording material according to the present invention may contain, for example, a light sensitive layer of binder in which the silver halide is predominantly sensitive to the red region as a result of spectral sensitisation and which contains a cyan dye releasing compound; another light sensitive layer of binder in which the silver halide has been spectrally sensitised predominantly to green and which contains a magenta dye releasing compound; and a third light sensitive layer of binder in which the silver halide is predominantly sensitive to blue, either due to its own intrinsic sensitivity or as a result of spectral sensitisation, and which contains a yellow dye releasing compound.

In another embodiment of the present invention, each of the above mentioned associations of light sensitive silver halide with dye releasing compounds is used in the form of a so called complex coacervate. By "complex coacervate" is meant a form of dispersion in which a mixture of the main constituents is enclosed in a common envelope of hardened binder. Dispersions of this kind are referred to as packet emulsion. They are obtained by complex coacervation.

Methods of preparing a packet emulsion in which a colour producing substance is incorporated by complex coacervation are described, for example, in U.S. Pat. Nos. 3 276 869 and 3 396 026. The use of packet emulsions in recording materials which are developable by heat is described, for example, in DE-A-35 10 685.

The use of packet emulsions according to the invention enables several emulsion components, including the dye releasing compounds, to be incorporated in a single layer of binder without any loss in the spectral association so that no colour falsification occurs. This is possible because the amount of dye released from that dye releasing compound which is present in the same coacervate particle (packet) as a given silver halide is determined almost exclusively by the extent to which the silver halide particle has been exposed to light. The use of packet emulsions thus enables one blue sensitive, one green sensitive and one red sensitive silver halide emulsion and the corresponding spectrally associated dye releasing compounds to be accommodated in the same layer of binder without the risk of serious colour falsification.

In addition to the components already mentioned, the colour photographic recording material according to the invention may contain other components and auxiliary substances which may be required, for example, for carrying out heat treatment and the tansfer of dye which forms part of this heat treatment. These other constituents and auxiliary substances may be present in a light sensitive layer or in a light insensitive layer.

These auxiliary substances may include, for example, auxiliary developers. These auxiliary developers generally have the effect of developing exposed silver halide. In the present case, they mainly act by promoting the reactions between the exposed silver halide an the reducing agent which may be identical with the dye releasing compound if the latter is an oxidizable compound whereas if a reducible dye releasing compound is used then the reducing agent may react with the releas-

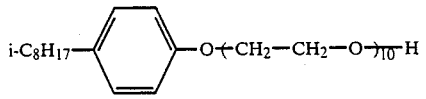

and 1.5 g of gelatine.

Layer 3

A protective layer containing 0.5 g of gelatine. A hardener is applied together with this protective layer.

The light sensitive element prepared as described above is referred to as sample 1 and serves as comparison sample. Another sample (sample 2) was prepared in similar manner but using 1.4 g of the aldehyde compound AV-1in layer 2.

An image receptor part for the photothermographic recording material was prepared by applying the following layers in succession to a layer support of polyethylene coated paper. The quantities given are based on 1 $m^2$.

Layer 1

A mordant layer containing 3 g of polymeric mordant (compound M) 0.09 g of saponin and 3 g of gelatine.

Compound M:

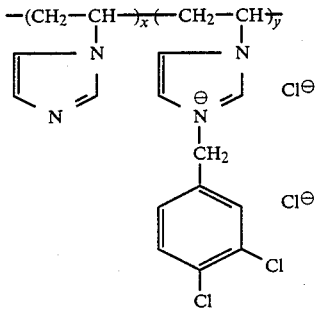

x = 95 mol %
y = 5 mol %

Layer 2

A covering layer containing 0.5 g of the UV absorbent Tinuvin ® 109 (trade product of Ciba Geigy) and 1.9 g of gelatine.

Layer 3

A harening layer containing 0.35 g of dimethylolurea and 1 g of gelatine.

Processing

One sheet of each light sensitive element (sample 1 and 2) was exposed through a step wedge. Development was carried out in two stages. In the first stage, the light sensitive element was heated to 120° C. for 60 seconds. This was carried out by means of a heating plate on which the sample was placed with its active side in contact with the plate and covered with another plate. In the second stage, the sample was brought with its active side into contact with the image receptor element which had previously been soaked in water. The resulting set was heated to 70° C. for 2 minutes by the same procedure as in the first stage. During this period, transfer of colour took place from the light sensitive element to the image receptor element. The two layer elements were then separated. A magenta negative image of the exposure original was obtained on the image receptor element.

In other variations of the development process, the time for the first reaction stage was increased form 60 seconds to 90 seconds and the temperature was increased from 120° C. to 130° C.

The results of developing samples 1 and 2 dependence upon the variations of the development process are summarized in Table 1. The density values given were determined behind green filters.

TABLE 1

| Sample | Addition of Aldehyde | Process | $E_{rel}$ | Dmin/Dmax |
|---|---|---|---|---|
| 1 | none | (1) 120° C./60 s | 2.08 | 0.20/2.16 |
| 1 | none | (2) 120° C./90 s | — | 1.55/2.26 |
| 1 | none | (3) 130° C./60 s | 2.15 | 0.85/1.98* |
| 2 | AV-1 | (1) 120° C./60 s | 1.82 | 0.14/2.14 |
| 2 | AV-1 | (2) 120° C,/90 s | 2.18 | 0.21/2.25 |
| 2 | AV-1 | (3) 130° C./60 s | 1.97 | 0.19/2.21 |

$E_{rel}$ = relative sensitivity in log Ixt units (higher values = higher sensitivity)
*Measurement was impaired by the formation of numerous vesicles in the layer arrangement.

Table 1 shows that the level of fog is visibly suppressed when the compound according to the invention is added. This becomes particularly pronounced when the processing time is increased or the processing temperature is raised, and a drastic increase in fog is found in comparison sample 1 compared with sample 2 according to the invention. When the compound according to the invention is added, therefore, changes in the processing conditions and any fluctuations in processing do not have a very pronounced effect so that the results obtained are more constant.

When guanidinium trichloroacetate is used as base donor, the cast layer is severely impaired by the formation of vesicles due to the liberation of chloroform and carbon dioxide by thermal decomposition, especially at the higher processing temperature (130° C.). Whereas sample 1 which did not contain the additive showed this effect to a very pronounced degree, sample 2 which contained the additive according to the invention showed virtually no formation of vesicles.

EXAMPLE 2

Layer 1

A layer containing a blue sensitized, sulphur-ripened silver halide emulsion of 0.5 g of $AgNO_3$ (2.5 mol % of AgCl, 97.5 mol % of AgBr, average grain diameter 0.7 μm) with 5 mg of 2-mercapto-5-sulphobenzimidazole, 0.4 g of dye releasing compound D, Dye releasing compound D

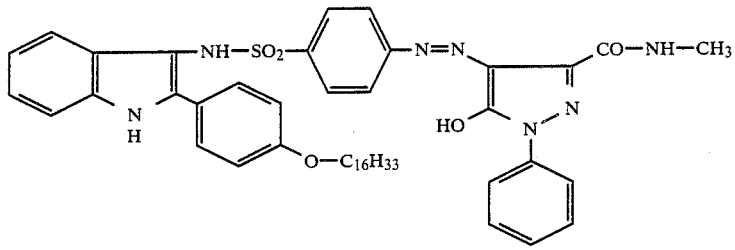

(emulsified in 0.2 g of diethyl lauramide), 0.02 g of potassium bromide, 1 g of polyesterurethane as in Example 1 and 1 g of gelatine.

Layers 2 and 3 were identical to layers 2 and 3 of Example 1. Sample 3 which contained no additive in layer 2 served as comparison sample while sample 4 contained 1.4 g of the aldehyde compound AV-1 according to the invention in layer 2.

Processing was carried out as described in Example 1. The results of developing the yellow transfer images (measurement behind blue filter) are summarized in Table 2.

TABLE 2

| Sample | Addition of Aldehyde | Process | $E_{rel}$ | Dmin/Dmax |
|---|---|---|---|---|
| 3 | none | 120° C./60 s | 2.46 | 0.45/2.06 |
| 3 | none | 120° C./90 s | — | 1.85/2.11 |
| 3 | none | 120° C./120 s | — | 2.08/2.14 |
| 3 | none | 130° C./60 s | — | 1.76/2.08 |
| 4 | AV-1 | 120° C./60 s | 1.55 | 0.20/1.96 |
| 4 | AV-1 | 120° C./90 s | 2.02 | 0.22/2.06 |
| 4 | AV-1 | 120° C./120 s | 2.09 | 0.25/2.11 |
| 4 | AV-1 | 130° C./60 s | 1.85 | 0.23/2.05 |

Table 2 also shows the powerful fog stabilizing effect of the additive according to the invention. Sample 4 shows virtually no formation of vesicles contrary to sample 3.

EXAMPLE 3

The arrangement of layers and the method of processing were similar to those of Example 1. Sample 1 which contained no additive served as comparison sample. Samples 5 to 9 contained the compounds according to the invention, AV-3, AV-5, AV-6, AV-10 and AV-11 in layer 2. The results of development (measurement behind green filter) are summarized in Table 3. These compounds also show a powerful fog stabilizing effect. The formation of vesicles caused, as already mentioned, by the thermal decomposition of guanidinium trichloroacetate, was in some cases almost completely, in others very markedly reduced.

TABLE 3

| Sample | Addition of Aldehyde | g/m² | Process | Dmin/Dmax |
|---|---|---|---|---|
| 1 | none | — | 120° C./60 s | 0.20/2.16 |
| 1 | none | — | 120° C./90 s | 1.55/2.26 |
| 1 | none | — | 130° C./60 s | 0.85/1.98 |
| 5 | AV-3 | 0.37 | 120° C./60 s | 0.15/2.15 |
| 5 | AV-3 | 0.37 | 120° C./90 s | 0.23/2.21 |
| 5 | AV-3 | 0.37 | 130° C./60 s | 0.19/1.96 |
| 6 | AV-5 | 0.58 | 120° C./60 s | 0.15/1.96 |
| 6 | AV-5 | 0.58 | 120° C./90 s | 0.22/2.23 |
| 6 | AV-5 | 0.58 | 130° C./60 s | 0.19/2.28 |
| 7 | AV-6 | 0.66 | 120° C./60 s | 0.15/2.01 |
| 7 | AV-6 | 0.66 | 120° C./90 s | 0.76/2.14 |
| 8 | AV-10 | 1.35 | 120° C./60 s | 0.15/1.89 |

TABLE 3-continued

| Sample | Addition of Aldehyde | g/m² | Process | Dmin/Dmax |
|---|---|---|---|---|
| 8 | AV-10 | 1.35 | 120° C./90 s | 0.25/2.14 |
| 8 | AV-10 | 1.35 | 130° C./60 s | 0.20/2.10 |
| 9 | AV-11 | 1.54 | 120° C./60 s | 0.15/1.96 |
| 9 | AV-11 | 1.54 | 120° C./90 s | 0.40/2.18 |
| 9 | AV-11 | 1.54 | 130° C./60 s | 0.23/2.17 |

EXAMPLE 4

No free aldehyde was used in this example, but the aldehyde releasing compounds AV-7, AV-8 and AV-9 indicated below. Samples 10, 11 and 12 were obtained. The arrangement of layers and method of processing were similar to those of Example 1.

The results (measurement behind green filter) are summarized in Table 4. The aldehyde releasing compounds shown in this Table also brought about a pronounced stabilization of fog in the material.

TABLE 4

| Sample | Addition of Aldehyde precursor | g/m² | Process | Dmin/Dmax |
|---|---|---|---|---|
| 10 | AV-7 | 0.14 | 120° C./60 s | 0.17/2.12 |
| 10 | AV-7 | 0.14 | 120° C./90 s | 0.70/2.30 |
| 10 | AV-7 | 0.14 | 130° C./60 s | 0.66/2.20 |
| 11 | AV-8 | 0.66 | 120° C./60 s | 0.13/1.79 |
| 11 | AV-8 | 0.66 | 120° C./90 s | 0.21/1.89 |
| 11 | AV-8 | 0.66 | 130° C./60 s | 0.19/1.86 |
| 12 | AV-9 | 0.63 | 120° C./60 s | 0.15/2.06 |
| 12 | AV-9 | 0.63 | 120° C./90 s | 0.66/2.09 |
| 12 | AV-9 | 0.63 | 130° C./60 s | 0.38/2.00 |

EXAMPLE 5

Example 1 was repeated but with the addition of silver benzotriazolate obtained from 0.25 g of $AgNO_3$ to layer 1. Sample 13 contained no aldehyde and served as comparison sample. Sample 14 contained 1.4 g of the aldehyde compound AV-1. Processing was carried out as described in Example 1. When development was carried out at 120° C./60 s in the first stage of the process, the Dimn/Dmax values obtained in sample 13 were 0.25/2.05 whereas in sample 14 the Dmin/Dmax ratio was 0.15/2.15 but the most pronounced difference was that the fog value was substantially lower.

We claim:

1. The photographic dye diffusion transfer process in which an imagewise exposed colour photographic recording material containing light sensitive silver halide an a non-diffusible dye releasing compound in at least one layer of binder on a layer support is developed by heat treatment to produce a diffusible dye image and in which the diffusible dye image is transferred to an image receptor layer, wherein said non-diffusible dye releasing compound is oxidizable and is capable of releasing a diffusible dye as a result of oxidation on development by heat treatment and wherein the development by heat treatment is carried out in the presence of a water soluble, substantially non-hardening aldehyde or a water soluble, substantially non-hardening precursor thereof, said aldehyde corresponding to the following formula I:

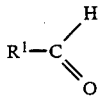

I wherein $R^1$ denotes H, alkyl, aralkyl or $(NH)_n—R^2$;

$R^2$ denotes aryl or a heterocyclic group and n=0 the groups denoted by $R^1$ being optionally substituted so that said aldehyde or said aldehyde precursor compound is soluble in water by at least 5 g in 100 ml of water at 20° C.

2. Colour photographic recording material for carrying out the process as claimed in claim 1, having at least one layer of binder on a layer support, which layer of binder contains light sensitive silver halide and a non-diffusible oxidizable dye releasing compound which is capable of releasing a diffusible dye as a result of oxidation on development by heat treatment, said recording material further containing a water soluble, substantially non-harding aldehyde or a water soluble, substantially non-hardening precursor thereof in the layer containing the light sensitive silver halide and the dye releasing compound and/or in another layer, said aldehyde corresponding to the following formula I:

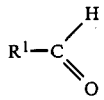

I wherein p1 $R^1$ denotes H, alkyl, aralkyl or $(NH)_n—R^2$;

$R^2$ denotes aryl or a heterocyclic group and n=0, the groups denoted by $R^1$ being optionally substituted so that said aldehyde or said aldehyde precursor compound is soluble in water by at least 5 g in 100 ml of water at 20° C.

3. Recording material according to claim 2, characterised in that the layer containing the light sensitive silver halide in addition contains a silver salt of an organic cyclic imino compound as oxidizing agent.

4. Recording material according to claim 3, characterised in that the organic cyclic imino compound is benzotriazole or a derivative of benzotriazole.

5. Dye diffusion transfer process according to claim 1, characterized in that development is carried out by heat treatment without the supply of a processing liquid.

* * * * *